United States Patent [19]

Huffman et al.

[11] Patent Number: 4,536,035

[45] Date of Patent: Aug. 20, 1985

[54] HYDRAULIC MINING METHOD

[75] Inventors: Lester H. Huffman; Gerald S. Knoke, both of Kent, Wash.

[73] Assignee: The United States of America as represented by the United States Department of Energy, Washington, D.C.

[21] Appl. No.: 621,294

[22] Filed: Jun. 15, 1984

[51] Int. Cl.[3] ..... E21C 37/12

[52] U.S. Cl. ..... 299/17; 175/67; 166/52

[58] Field of Search ..... 299/17, 16; 175/67; 166/50, 52

[56] References Cited

U.S. PATENT DOCUMENTS

| | | | |
|---|---|---|---|
| 1,851,565 | 3/1932 | Claytor | 299/6 |
| 2,518,591 | 8/1950 | Aston et al. | 175/215 |
| 2,720,381 | 10/1955 | Quick | 166/312 |
| 3,155,177 | 11/1964 | Fly | 299/17 |
| 3,393,013 | 7/1968 | Hammer et al. | 175/67 |
| 3,439,953 | 4/1969 | Pfefferle | 175/67 |
| 3,797,590 | 3/1974 | Archibald et al. | 299/17 |
| 3,900,226 | 8/1975 | de Jong | 175/67 |
| 4,024,914 | 5/1977 | Kreinin | 166/256 |
| 4,059,166 | 11/1977 | Bunnelle | 175/232 |
| 4,140,346 | 2/1979 | Barthel | 299/17 |
| 4,220,203 | 9/1980 | Steeman | 166/50 |
| 4,401,345 | 8/1983 | Archibald | 175/213 |

*Primary Examiner*—Stephen J. Novosad
*Assistant Examiner*—Michael Goodwin
*Attorney, Agent, or Firm*—Edward W. Nypaver; Judson R. Hightower

[57] ABSTRACT

A method of hydraulically mining an underground pitched mineral vein comprising drilling a vertical borehole through the earth's lithosphere into the vein and drilling a slant borehole along the footwall of the vein to intersect the vertical borehole. Material is removed from the mineral vein by directing a high pressure water jet thereagainst. The resulting slurry of mineral fragments and water flows along the slant borehole into the lower end of the vertical borehole from where it is pumped upwardly through the vertical borehole to the surface.

9 Claims, 9 Drawing Figures

HYDRAULIC MINING METHOD

BACKGROUND OF THE INVENTION

This invention relates generally to the mining art and, more particularly, to a method and system of hydraulically mining pitched or inclined underground mineral veins, such as coal seams.

A known technique employed in extracting certain unconsolidated ores found in isolated lensatic deposits or pockets is the hydraulic vertical borehole mining process. This process involves predrilling a vertical borehole into the ore formation and lining the borehole with a casing if the overburden is unconsolidated material. A mining tool is then inserted through the borehole and serves to disintegrate the ore by jetting a fluid, usually water, into the ore formation. The liquid containing the removed ore in suspension forms a slurry which is pumped upwardly through the borehole to the ground surface. While this process admirably serves its intended purpose for recovering ore from isolated underground pockets, it has not proven economically feasible in mining continuous underground mineral veins, such as coal seams for example.

Conventional coal mining is invariably performed in near-level coal seams. Pitched coal seams, i.e., seams that extend downwardly at an angle from a true horizontal, generally have been avoided because of the excessive cost incurred in recovering the coal. As a result, hundreds of millions of tons of coal reserves remain buried in these pitched coal seams.

Some pitched coal seams are currently being mined by the wellknown technique of strip mining until the cost of removing the overburden becomes prohibitive. In some instances, further recovery of strip mined coal is achieved by employing augers which drill down the dip of the pitched seam. However, the augering method has a limitation of several hundred feet, thereby leaving behind reserves of unmined coal. In either event, this strip mining technique involves extensive surface disruption creating safety hazards and environmental problems, as well as adversely affecting local ground water and surface streams. Moreover, the accumulation and disposal of overburden wastes poses ecological and economic problems. Consequently, most pitched coal seams have never been mined except for scavenging along the outcrop.

Accordingly, it is a primary object of the present invention to provide a new and useful method of hydraulically mining underground pitched mineral veins extending downwardly at an angle relative to a true horizontal.

It is another object of this invention to provide a method of hydraulically mining pitched mineral veins while minimizing surface disruption and the accumulation of shale and rock wastes on the surface of the earth.

It is a further object of the present invention to provide an improved hydraulic mining method avoiding damage to ground water quality and hydrology and avoiding surface water pollution.

These and other objects, advantages, and characterizing features of this invention will become apparent from the ensuing detailed description of an illustrative embodiment thereof, when taken together with the accompanying drawings wherein like reference characters denote like parts throughout the various views.

SUMMARY OF THE INVENTION

A hydraulic mining method including drilling a vertical borehole into a pitched mineral vein and a slant borehole along the footwall of the vein to intersect the vertical borehole. Material is removed from the mineral vein by a fluid jet stream and the resulting slurry flows down the footwall borehole into the vertical borehole from where it is pumped upwardly therethrough to the surface.

DETAILED DESCRIPTION OF THE PREFERRED EMBODIMENT

Figure 1:
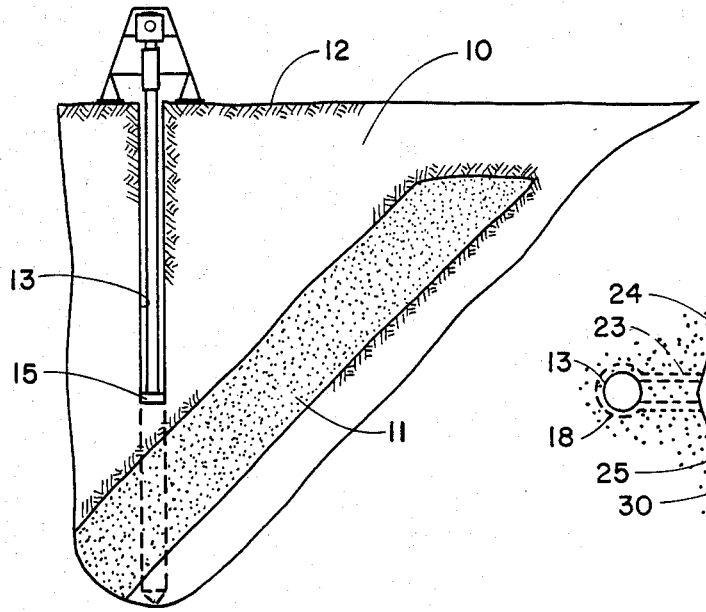
FIG. 1 is a diagrammatic vertical sectional view of the earth's lithosphere having a pitched mineral vein, showing a vertical borehole being formed to the bottom of the mineral vein.

Referring now in detail to the illustrative embodiment depicted in the accompanying drawings, there is shown in FIG. 1 a fragmentary vertical section of a portion of the earth's lithosphere 10 formed with a coal seam 11 extending downwardly at an angle of approximately 45 degrees relative to a true horizontal. Such sloping seams are commonly referred to as "pitching" seams in the mining art. The upper end of the seam 11 can extend to the surface 12 of the earth or terminate therebelow as shown in FIG. 1. While it will be convenient to describe the mining process of this invention in connection with the mining of coal, it should be understood that the method of this invention is not restricted thereto, but is equally applicable to the mining of any mineral vein having dip angles ranging from 25° to 75° relative to a true horizontal.

Figure 2:
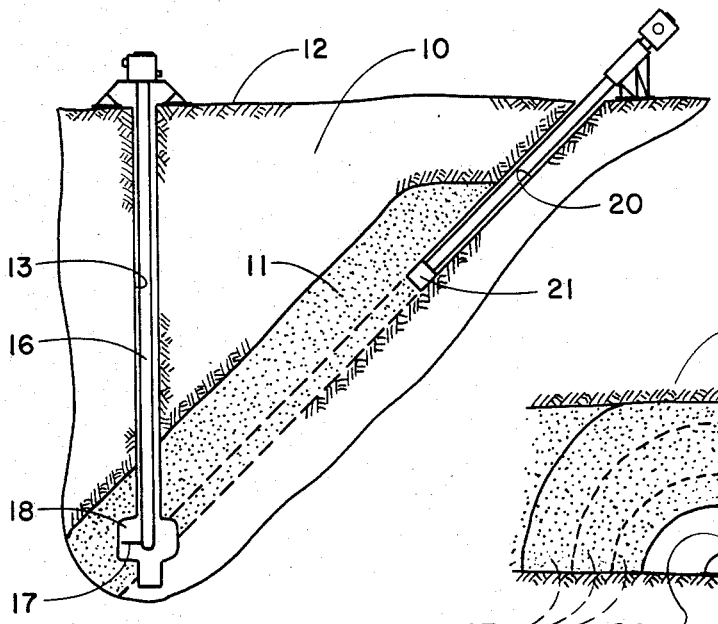
FIG. 2 is a view similar to FIG. 1, showing a slant borehole being formed along the footwall of the mineral vein.

In the preferred method of this invention, a vertical borehole 13 (FIG. 1) is drilled vertically downwardly through the earth's strata by a conventional drilling tool 15 down to a depth just below the pitched seam 11. As drilling of the borehole 13 progresses, the latter can be lined by suitable casing sections periodically added and cemented or otherwise fixidly secured in place in a well known manner. Upon completion of the vertical borehole 13, the drill tool 15 is removed and a pumping tool 16 (FIG. 2) is lowered into the borehole 13. The bottom of the pumping tool 16 is equipped with a nozzle ejecting a small cutting water jet stream 17 employed to form an enlarged diameter sump area or cavity 18 adapted to collect the coal slurry resulting from the mining operation as will hereinafter be described. This jet 17 also will serve as an agitation jet during the regular mining operation to facilitate pumping of the slurry up through tool 16. The bottom of the pumping tool also can be equipped with a crusher to reduce the size of the mineral to a size suitable for pumping.

Upon completion of the vertical borehole 13, a slant borehole 20 is drilled from the surface 12 downwardly through the overburden and along the footwall of seam 11 by a suitable slant drilling tool 21. Drilling is continued along the bottom of the coal seam 11 until slant borehole 20 intersects the vertical borehole 13. In order to guide the drilling tool 21 toward borehole 13, various known guidance arrangements including signaling and sensing devices can be employed. For example, an electro-magnetic field sensor (not shown) can be installed at the bottom of the vertical borehole 13 to serve as a target and the drill tool 21 can be provided with a transmitting antenna mounted coaxially in the drill tool 21. The transmitter generates an electromagnetic field received at the sensor which, in turn, generates a signal that increases with the extent or degree of drill deviation or misalignment from the target so that corrective action can be taken. Also, a back-up method may be utilized which combines drill guidance with real-time position logging such that the drill position can be compared with the logged location of the vertical borehole 13.

Figure 6:
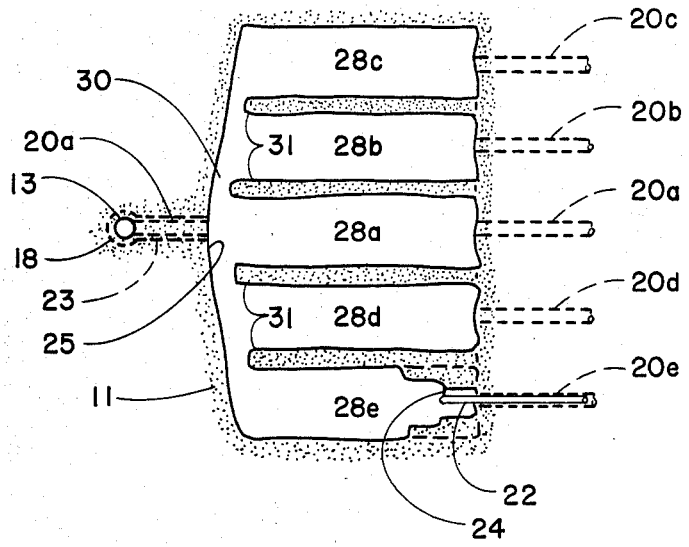
FIG. 6 is a sectional plan view, taken along the line 6—6 of FIG. 5.

Once the slant borehole 20, identified as 20*a* in FIG. 6, intersects the vertical borehole 13, the drill tool 21 is withdrawn. In a similar manner, adjacent slant boreholes 20*b*–20*e* (FIG. 6) are formed on fifty foot centers along the seam strike. These boreholes 20*b*–20*e* do not intersect vertical borehole 13 but are parallel to the primary borehole 20*a* and to each other, running along the footwall of the seam 11. The only casing required for these several boreholes is through the overburden to the coal seam 11. While five slant boreholes are depicted in the illustrative embodiment of FIG. 6, it should be appreciated that more or less than five slant boreholes per vertical borehole can be drilled, as desired or dictated by the strata conditions being mined.

Figure 3:
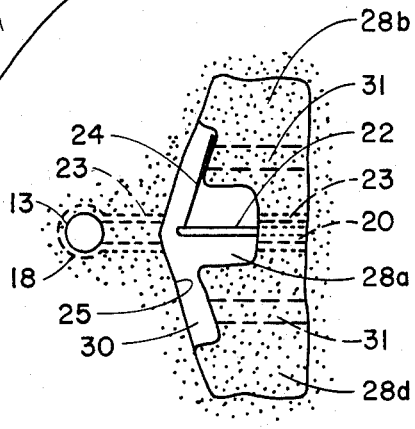
FIG. 3 is a diagrammatic fragmentary plan view of the mineral vein of FIG. 1, showing an early stage of a mining operation.

After the selected number of slant boreholes have been formed, a rotatable cutting tool 22 is then inserted into the primary slant borehole 20*a* and lowered to the end of borehole 20*a* with the tool 22 resting along the footwall of the coal seam 11. A small radius slurry drain passage 23 is first formed to facilitate the subsequent flow of slurry to the sump cavity 18. Cutting is initiated by a water jet stream 24 (FIG. 3) emitted radially from the rotatable cutting tool 22. The water jet is directed under high pressure against the exposed surface of the seam to impact and disintegrate the material therefrom. The detached material forms with the water a slurry which flows by gravity to the footwall. The water jet 24 is angled approximately 3° (shown exaggerated in FIG. 3) from a plane perpendicular to the longitudinal axis of the cutting tool 22 to provide an incline 25 along the face of seam 11 to facilitate the flow of slurry to the central drain passage 23 and then to sump cavity 18.

Figure 4:
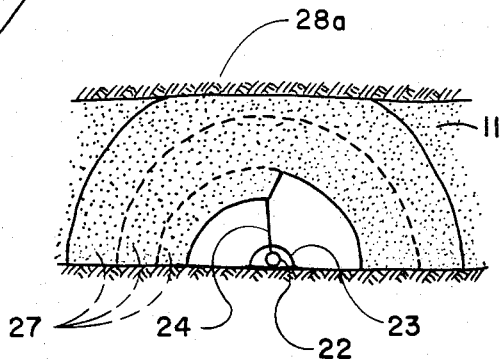
FIG. 4 is a cross-sectional view through the mineral vein showing the pattern of cutting performed in the vein.

As shown in FIG. 4, the jet stream 24 is rotated approximately 180° as it is slowly shifted axially to remove incremental arcuate layers of predetermined lengths of the mineral, the arcuate layers being identified by numeral 27. This hydraulic or water pressure technique for decomposing or removing mineral from the vein or seam is well known and no further amplification or description thereof is believed necessary. If desired, reference may be made to U.S. Pat. Nos. 1,851,565; 3,155,177; and 4,401,345, which disclose details of hydraulic mining systems employing cutting water jets. Mining progresses upwardly through the coal seam 11 to form a cavity 28*a* having straight upper and lower walls and arcuate sidewalls in cross section as shown in FIG. 4.

As earlier mentioned, the mineral removed from the seam falls by gravity to the footwall and flows in suspension with the water as a slurry by gravity therealong and into the slurry drain passage 23 to sump cavity 18. The pumping tool 16, which may also include an internal crushing mechanism to reduce large fragments to transportable size, delivers the slurry upwardly to the surface where it is directed by suitable conduits to a coal dewatering station. A large fraction of the water can be removed from the coal slurry and recycled to a holding pond from which it may be filtered and pumped back to the cutting tool as required. The resulting wet coal can then be pile dried prior to transportation to a storage and/or loadout area. Alternatively, the material can be dewatered at the tool and pumped in a coal concentrated form to the coal preparation facility. In either event, all operations are carried out remotely from above the ground surface and can be efficiently performed by only a few operators or workmen.

Figure 5:
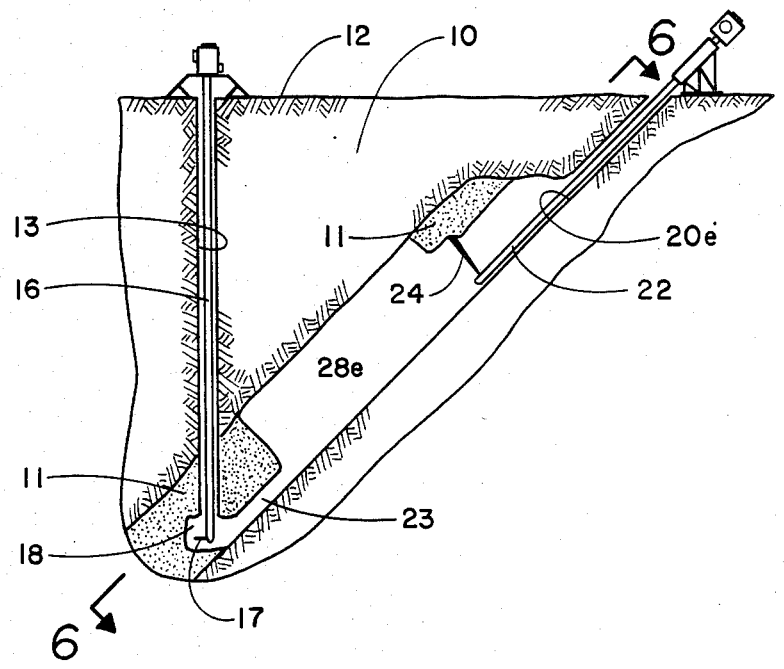
FIG. 5 is a view similar to FIG. 1, showing the mining of a cavity extending upwardly of the dip.

As the mining of the first cavity 28*a* is begun, the cutting water jet 24 is directed laterally beyond the side walls otherwise defining cavity 28*a* to form a forward passage 30 for the flow of slurry between the subsequently mined cavities 28*b* and 28*d* (FIG. 6). After mining the first cavity 28*a*, the cutting tool 22 is removed therefrom and inserted into the adjacent borehole 20*b* to form the next succeeding cavity 28*b*. A partition or pillar 31 is left remaining between adjacent cavities to support the roof and overburden. The remaining cavities 28*c*–28*e* are successively mined in a similar manner. FIGS. 5 and 6 depict the pattern formed in the coal seam 11 as the final cavity 28*e* is being completed.

In a typical hydraulic mining operation in accordance with the process of this invention, the vertical borehole drilled is approximately 24 inches in diameter for receiving an 18 inch diameter pumping tool. The size of the slant boreholes are about 12 inches in diameter to accommodate the cutting tool. The slurry drain passage 23 has a radius of from two to four feet. The completed cavities have a height or thickness approximating the height or thickness of the coal seam, say ten feet for example, and a width of about 20 feet and extend from the upper end of the pitched seam 11 down to a location near the vertical borehole 13. The pillars 31 left remaining between adjacent cavities are about ten feet wide and, except for the passages 30, extend lengthwise of the cavities. These dimensions are exemplary only and can vary widely as dictated by the thickness and dimensions of the coal seam 11 and the structural characteristics of the subterranean formation.

The double-drill method of hydraulic mining described above in accordance with this invention provides for maximum safety since operators or workmen are not required to enter the cavities being mined as opposed to conventional underground mining. Moreover, surface disruptions are minimal because no overburden is removed as required in strip mining. Since only a negligible amount of host rock or strata is removed, waste disposal of shale and rock is kept to a minimum. Also, the quality of local ground water and surface streams remains unaffected because only recycled water is used for the process.

Figure 7:
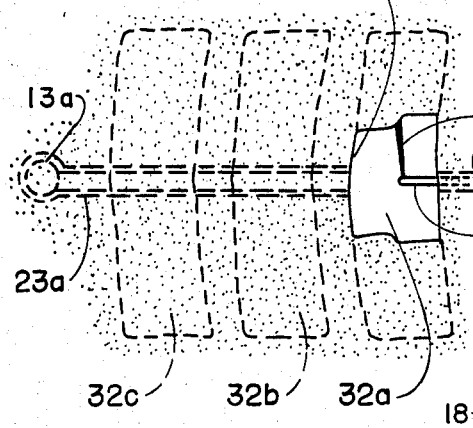
FIG. 7 is a diagrammatic, fragmentary plan view of a mineral vein, showing another form of hydraulic mining of this invention.
Figure 9:
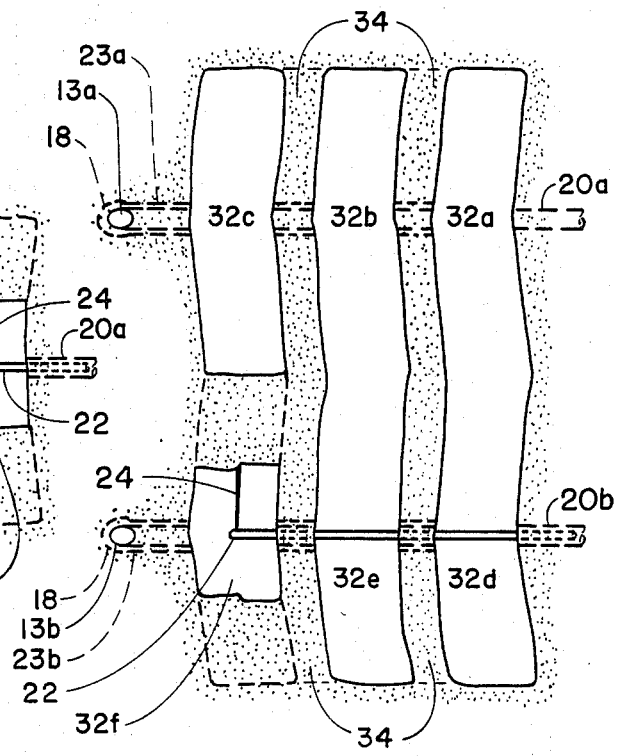
FIG. 9 is a sectional plan view, taken along the line 9—9 of FIG. 8.
Figure 8:
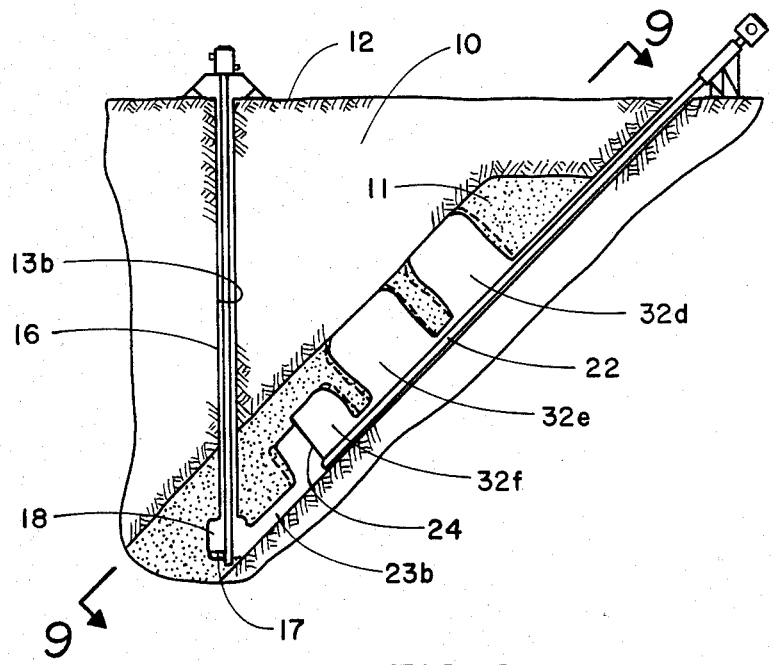
FIG. 8 is a view similar to FIG. 1, showing the other form of mining illustrated in FIG. 7.

FIGS. 7–9 illustrate another form of a double-drill hydraulic mining process of this invention. This embodiment differs from that first described in that the mined cavities extend horizontally rather than longitudinally along the seam 11 and mining progresses from the upper end of the seam downwardly toward the vertical borehole. As shown in FIG. 7, a vertical borehole 13*a* is drilled down through the earth's strata, down to a depth just below the pitched coal seam 11. When completed, the drilling tool is removed and a pumping tool 16 is inserted therein (FIG. 8). An enlarged diameter sump area or cavity 18 is formed as earlier described in connection with the embodiment of FIGS. 1–6.

Upon completion of the vertical borehole 13*a*, a slant borehole 20*a* is formed by drilling tool 21 along the footwall of the seam 11 to intersect the vertical borehole 13*a*. After the slant borehole is formed, the drilling tool 21 is withdrawn and a cutting tool 22 is inserted into slant borehole 20*a*. The cutting tool 22 becomes operative to form a small radius slurry drain passage 23*a* down along the footwall of seam 11 to the associated borehole 13*a*. The cutting tool 22 is then retracted to a position adjacent the upper end of the seam 11 and mining is initiated (FIG. 7) to form a first cavity 32*a* approximately 40 feet wide and 80 feet long. As before, the cutting jet stream 24 is directed slightly upwardly to form an inclined face 33 to facilitate the flow of slurry toward the slurry drain passage 23*a*. The cutting tool 22 is then advanced to form the next succeeding cavity 32*b*, leaving a pillar 34 about ten feet wide therebetween. This procedure continues until all of the cavities 32*a*–32*c* emptying into slurry drain passage 23*a* have been formed.

The next vertical borehole 13*b*, slant borehole 20*b*, and slurry drain passage 23*b* are formed to repeat the above described cycle in forming cavities 32*d*–32*f*. These successive cavities 32*d*–32*f* overlap with the previously formed cavities 32*a*–32*c*, respectively, to form continuous, extended horizontal cavities across the entire coal seam 11.

FIGS. 8 and 9 depict the pattern formed in the coal seam 11 as cavity 32*f* is being completed. As a matter of expediency, the vertical borehole 13*b*, spaced about 80 feet laterally from borehole 13*a*, as well as the subsequent formation of slant borehole 20*b* and slurry drain passage 23*b*, can be drilled while the cavities 32*a*–32*c* are being mined. This process can be repeated along the entire width of the seam 11 to thereby establish a continuous mining operation without interruption.

The foregoing description of preferred embodiments of this invention have been presented for purposes of illustration and description only, and they are not intended to be exhaustive or to limit the invention to the precise forms disclosed. They were chosen and described in order to best explain the principles of the invention and their practical application to thereby enable others skilled in the art to best utilize the invention in various embodiments and with various modifications as are suited to the particular application contemplated. It is intended that the scope of the invention be defined by the claims appended hereto.

We claim:

1. A method of hydraulically mining an underground pitched mineral vein extending downwardly at an angle into the earth's lithosphere comprising: drilling a vertical borehole extending from the ground surface to a depth adjacent the footwall of said mineral vein, forming an enlarged diameter sump cavity at the lower end of said vertical borehole, drilling a slant borehole from said ground surface and along said footwall to intersect the lower end of said vertical borehole, removing material from said mineral vein by directing a fluid jet stream thereagainst, said removed material forming with said water a slurry flowing down said footwall into said sump cavity, and pumping said slurry upwardly through said vertical borehole to the ground surface.

2. A method according to claim 1, including forming an enlarged diameter slurry drain passage along said slant borehole for accommodating slurry flow into said vertical borehole.

3. A method according to claim 1, including forming a V-shaped face generally perpendicular to said vein footwall adjacent said sump cavity.

4. A method according to claim 1, including initiating a mining operation by removing material from an area of said mineral vein adjacent said vertical borehole progressively upwardly along said mineral vein toward said ground surface to form a longitudinal cavity of predetermined width and a thickness approximating the thickness of said vein.

5. A mining method comprising forming a plurality of laterally spaced longitudinal cavities according to the method of claim 4, and spacing adjacent cavities by leaving elongated pillars of mineral vein therebetween during the mineral removing operation.

6. A mining method according to claim 5, including forming lateral passages between adjacent cavities at the lower ends thereof for the free flow of slurry therebetween.

7. A method according to claim 1, including initiating a mining operation by removing material laterally from an area of said mineral vein adjacent the ground surface to form a horizontally extending cavity of predetermined width and a thickness approximating the thickness of said vein.

8. A mining method comprising forming a plurality of longitudinaly spaced horizontal cavities according to claim 7, and spacing adjacent cavities by leaving horizontally extending pillars of mineral vein therebetween during the mineral removing operation.

9. A method according to claim 1, including crushing fragments of removed mineral to transportable size before pumping said slurry upwardly through said vertical borehole.

* * * * *